US011145475B1

(12) United States Patent
Wu et al.

(10) Patent No.: US 11,145,475 B1
(45) Date of Patent: Oct. 12, 2021

(54) KEYBOARD DEVICE AND KEY STRUCTURE THEREOF

(71) Applicant: Primax Electronics Ltd., Taipei (TW)

(72) Inventors: Ming-Han Wu, Taipei (TW); Che-Wei Yang, Taipei (TW); Yi-Wei Chen, Taipei (TW); Chien-Hung Liu, Taipei (TW); Chen-Hsuan Hsu, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/081,495

(22) Filed: Oct. 27, 2020

(30) Foreign Application Priority Data

Sep. 18, 2020 (TW) ..... 109132413

(51) Int. Cl.
*H01H 13/70* (2006.01)
*H01H 13/705* (2006.01)

(52) U.S. Cl.
CPC ..... *H01H 13/705* (2013.01); *H01H 2233/07* (2013.01)

(58) Field of Classification Search
CPC .. H01H 13/705; H01H 2233/07; H01H 13/10; H01H 13/70
USPC ..... 200/5 A
See application file for complete search history.

(56) References Cited

U.S. PATENT DOCUMENTS 7,750,261 B2 * 7/2010 Tsai ..... G06F 1/1616 200/302.2
10,147,568 B1 * 12/2018 Yeh ..... H01H 3/125
2007/0199804 A1 * 8/2007 Joseph ..... H01H 13/705 200/5 A
2014/0014488 A1 * 1/2014 Tsai ..... H01H 13/88 200/5 A

* cited by examiner

*Primary Examiner* — Edwin A. Leon
*Assistant Examiner* — Iman Malakooti
(74) *Attorney, Agent, or Firm* — Kirton McConkie; Evan R. Witt

(57) ABSTRACT

A keyboard device includes plural key structures. Each key structure includes a plate assembly, a keycap, a connecting member and a buffering element. The plate assembly has a hollow region. The keycap is located over the plate assembly. The connecting member is connected between the keycap and the plate assembly. The keycap is connected with the connecting member through at least one hook of the keycap. The keycap is movable upwardly or downwardly relative to the plate assembly through the connecting member. The buffering element is installed on the plate assembly. The buffering element is extended in a direction toward the keycap and penetrated through the hollow region of the plate assembly. While the keycap is moved downwardly and the at least one hook of the keycap is contacted with the buffering element, there is the gap between the keycap and the plate assembly.

12 Claims, 6 Drawing Sheets

KEYBOARD DEVICE AND KEY STRUCTURE THEREOF

FIELD OF THE INVENTION

The present invention relates to an input device, and more particularly to a keyboard device and a key structure thereof.

BACKGROUND OF THE INVENTION

With increasing development of science and technology, a variety of electronic devices are designed in views of convenience and user-friendliness. For helping the user well operate the electronic devices, the electronic devices are gradually developed in views of humanization. The input devices of the common electronic devices include for example mouse devices, keyboard devices, trackball devices, or the like. Via the keyboard device, characters or symbols can be inputted into the computer system directly. As a consequence, most users and most manufacturers of input devices pay much attention to the development of keyboard devices.

Generally, a keyboard device comprises plural key structures. Each key structure comprises a keycap, a scissors-type connecting member, a membrane circuit board and a supporting plate. These components are stacked on each other sequentially. In case that the keyboard device is a luminous keyboard device, the keyboard device is equipped with a backlight module under the supporting plate.

Moreover, a membrane switch is installed on the membrane circuit board, and an elastic element is arranged between the keycap and the membrane circuit board. The scissors-type connecting member is connected between the keycap and the supporting plate. Moreover, the scissors-type connecting member comprises a first frame and a second frame. The second frame is pivotally coupled to the first frame. Consequently, the first frame and the second frame can be swung relative to each other. While the keycap of any key structure is depressed and moved downwardly relative to the supporting plate, the first frame and the second frame of the scissors-type connecting member are switched from an open-scissors state to a stacked state. Moreover, as the keycap is moved downwardly to compress the elastic element, the corresponding membrane switch is pushed and triggered by the elastic element. Consequently, the keyboard device generates a corresponding key signal.

When the keycap of the key structure is no longer depressed, the keycap is moved upwardly relative to the supporting plate in response to an elastic force of the elastic element. Meanwhile, the first frame and the second frame are switched from the stacked state to the open-scissors state again, and the keycap is returned to its original position.

However, the conventional keyboard device still has some drawbacks. While the keycap of the key structure is depressed and moved downwardly relative to the supporting plate, the keycap readily collides with the supporting plate to generate a click sound. That is, the collision between the keycap and the membrane circuit board generates a kinetic energy, and the kinetic energy is transferred downwardly to the metallic supporting plate to generate the sound. The click sound is unpleasant noise to the user.

In other words, the conventional keyboard device needs to be further improved.

SUMMARY OF THE INVENTION

An object of the present invention provides a keyboard device with a key structure. A plate assembly of the key structure is equipped with a buffering element. While the keycap is depressed, the keycap is moved downwardly toward the plate assembly through the connecting member. When at least one hook of the keycap is contacted with the buffering element, there is the gap between the keycap and the plate assembly. Since the keycap does not directly collide with the plate assembly, the noise reduction efficacy is enhanced.

Another object of the present invention provides a key structure. A plate assembly of the key structure is equipped with a buffering element. While the keycap is depressed, the keycap is moved downwardly toward the plate assembly through the connecting member. When at least one hook of the keycap is contacted with the buffering element, there is the gap between the keycap and the plate assembly. Since the keycap does not directly collide with the plate assembly, the noise reduction efficacy is enhanced.

The other objects and advantages of the present invention will be understood from the disclosed technical features.

In accordance with an aspect of the present invention, a keyboard device is provided. The keyboard device includes plural key structures. Each key structure includes a plate assembly, a keycap, a connecting member and a buffering element. The plate assembly has a hollow region. The keycap is located over the plate assembly. The keycap includes at least one hook. The connecting member is connected between the keycap and the plate assembly. The keycap is connected with the connecting member through the at least one hook. Consequently, the keycap is movable upwardly or downwardly relative to the plate assembly through the connecting member. The buffering element is installed on the plate assembly. The buffering element is extended in a direction toward the keycap and penetrated through the hollow region of the plate assembly. While the keycap is moved downwardly toward the plate assembly and the at least one hook of the keycap is contacted with the buffering element, there is the gap between the keycap and the plate assembly.

In an embodiment, when the at least one hook of the keycap is contacted with the buffering element, the buffering element is subjected to an elastic deformation. A deformation amount of the buffering element corresponding to the elastic deformation is in a range between 0.05 mm and 1 mm.

In an embodiment, the plate assembly includes a supporting plate and a membrane circuit board. The supporting plate has a first perforation. The membrane circuit board is arranged between the keycap and the supporting plate. The membrane circuit board includes a second perforation. The first perforation and the second perforation are in communication with each other. The first perforation and the second perforation are collaboratively formed as the hollow region.

In an embodiment, the keycap further includes an upper portion and a skirt portion. The skirt portion is extended from the upper portion in a direction toward the plate assembly. When the at least one hook of the keycap is contacted with the buffering element, there is the gap between the skirt portion and the membrane circuit board of the plate assembly.

In an embodiment, the key structure further includes a waterproof plate, and the waterproof plate is located under the plate assembly. The waterproof plate and the buffering element are integrally formed as a one-piece structure.

In an embodiment, the waterproof plate and the buffering element are made of polycarbonate or polyethylene terephthalate.

In an embodiment, the key structure further includes a waterproof plate, and the waterproof plate is located under the plate assembly. The buffering element is disposed on the waterproof plate.

In an embodiment, the waterproof plate is made of polycarbonate or polyethylene terephthalate, and the buffering element is made of silicone resin or rubber.

In an embodiment, each key structure further includes an elastic layer. The elastic layer is disposed on a top surface of the elastic layer. While the keycap is moved downwardly toward the plate assembly and the at least one hook of the keycap is contacted with the elastic layer, there is the gap between the keycap and the plate assembly.

In accordance with another aspect of the present invention, a key structure is provided. The key structure includes a plate assembly, a keycap, a connecting member and a buffering element. The plate assembly has a hollow region. The keycap is located over the plate assembly. The keycap includes at least one hook. The connecting member is connected between the keycap and the plate assembly. The keycap is connected with the connecting member through the at least one hook. Consequently, the keycap is movable upwardly or downwardly relative to the plate assembly through the connecting member. The buffering element is installed on the plate assembly. The buffering element is extended in a direction toward the keycap and penetrated through the hollow region of the plate assembly. While the keycap is moved downwardly toward the plate assembly and the at least one hook of the keycap is contacted with the buffering element, there is the gap between the keycap and the plate assembly From the above descriptions, the present invention provides the keyboard device. The plate assembly of the key structure of the keyboard device is equipped with the buffering element. While the keycap of the key structure is depressed, the keycap is moved downwardly toward the plate assembly through the connecting member. When the at least one hook of the keycap is contacted with the buffering element, there is the gap between the keycap and the plate assembly. Due to the structural design, the keycap will not directly collide with the plate assembly. Since the generated sound is reduced during the process of depressing the key structure, the noise reduction efficacy is enhanced.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
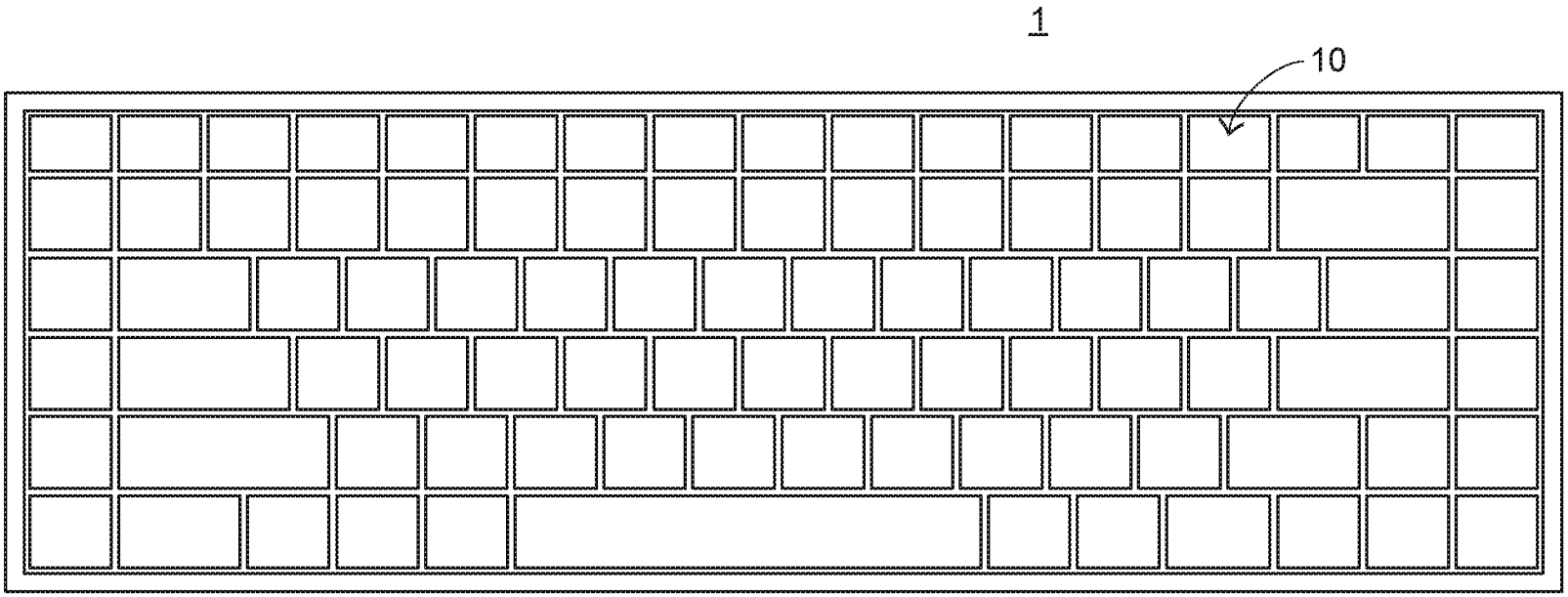
FIG. 1 is a schematic top view illustrating the outer appearance of a keyboard device according to an embodiment of the present invention.
Figure 2:
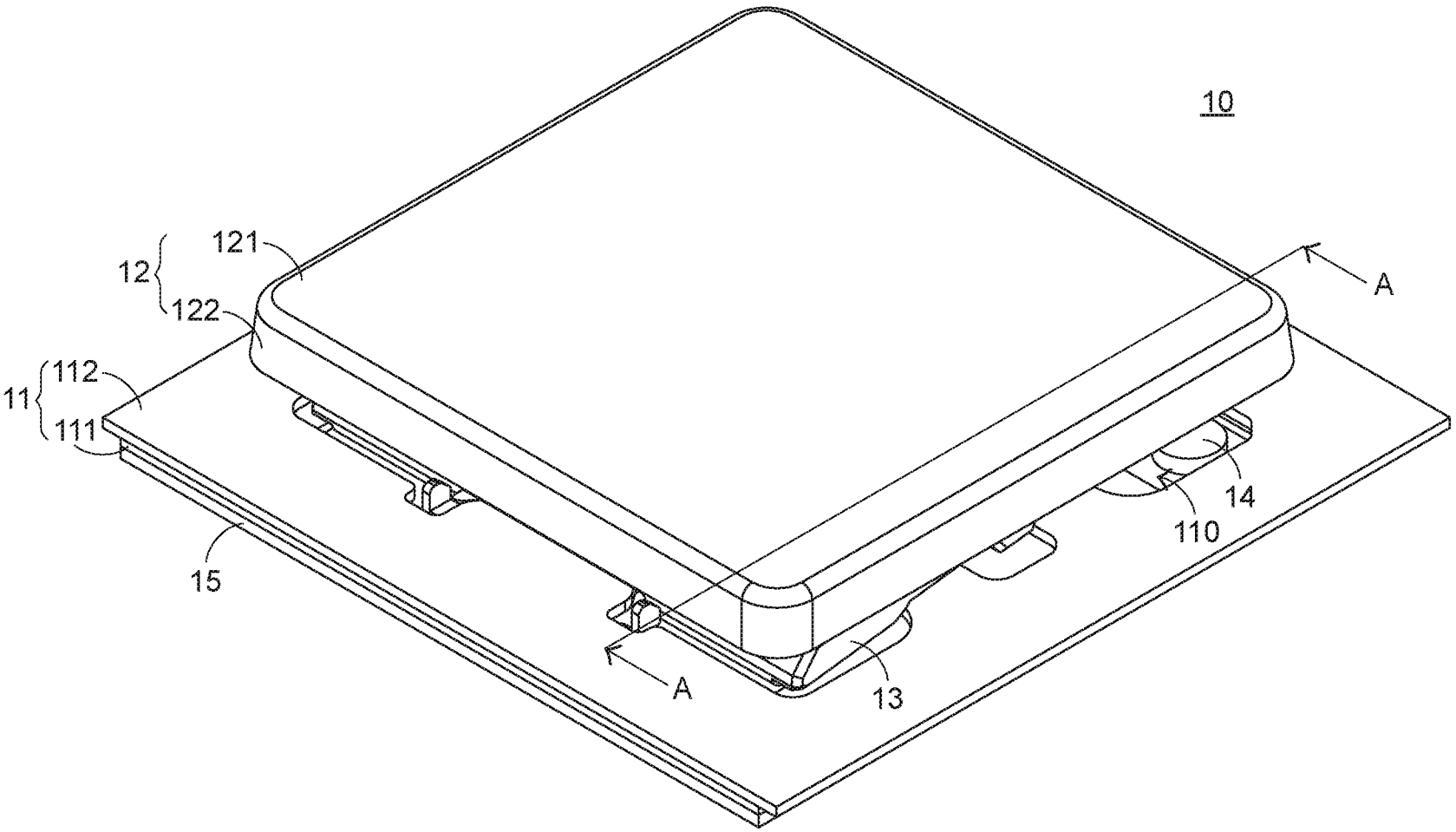
FIG. 2 is a schematic perspective view illustrating a key structure of the keyboard device as shown in FIG. 1.
Figure 3:
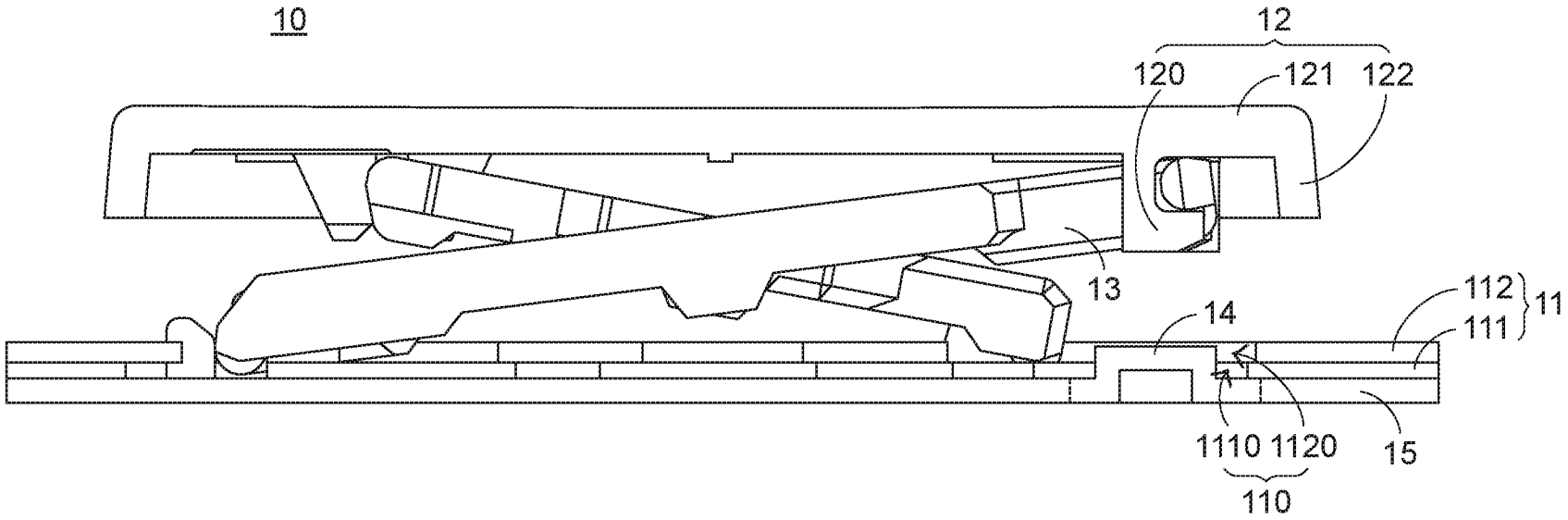
FIG. 3 is a schematic cross-sectional view illustrating the key structure of FIG. 2 and taken along the line AA.
Figure 4:
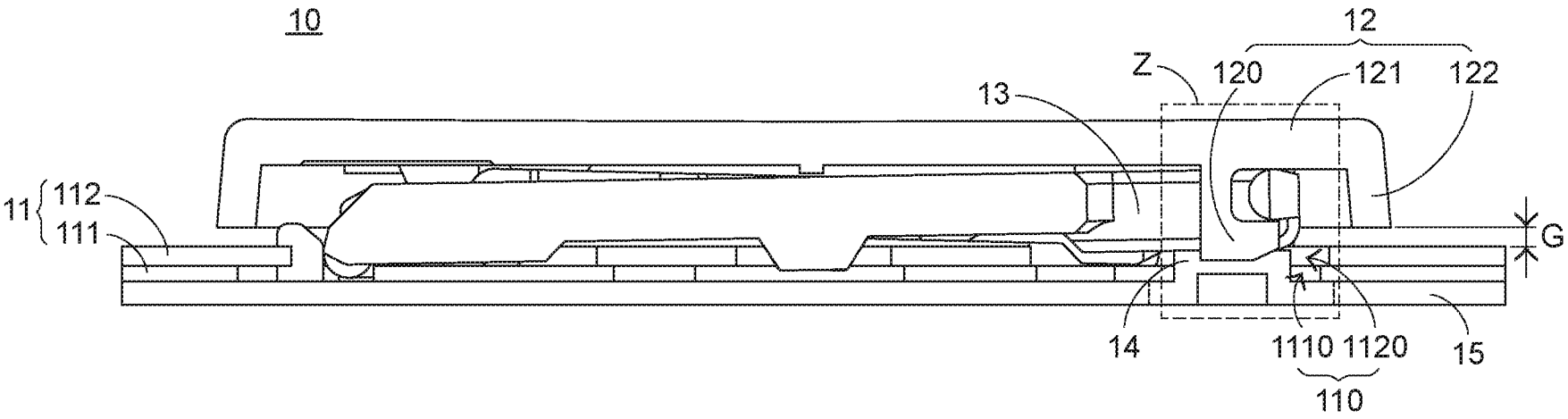
FIG. 4 is a schematic cross-sectional view illustrating the key structure of FIG. 3 in a depressed state.
Figure 5:
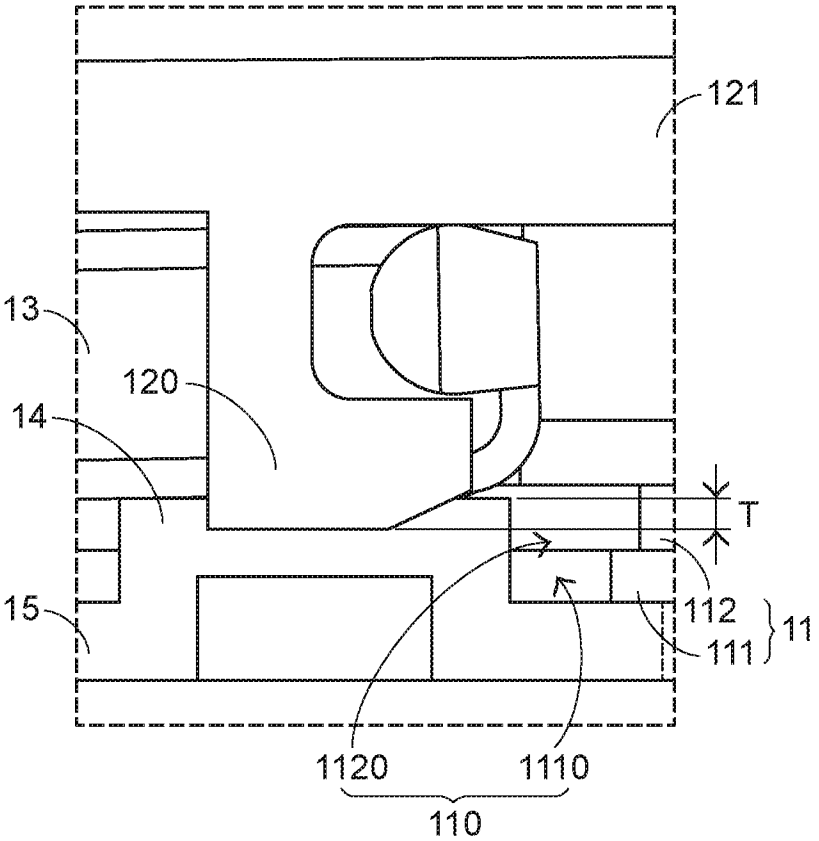
FIG. 5 is a schematic enlarged view illustrating the region Z of FIG. 4.

Please refer to FIGS. 1, 2, 3, 4 and 5. FIG. 1 is a schematic top view illustrating the outer appearance of a keyboard device according to an embodiment of the present invention. FIG. 2 is a schematic perspective view illustrating a key structure of the keyboard device as shown in FIG. 1. FIG. 3 is a schematic cross-sectional view illustrating the key structure of FIG. 2 and taken along the line AA. FIG. 4 is a schematic cross-sectional view illustrating the key structure of FIG. 3 in a depressed state. FIG. 5 is a schematic enlarged view illustrating the region Z of FIG. 4.

As shown in FIG. 1, the keyboard device 1 comprises plural key structures 10. These key structures 10 are classified into some types, e.g., ordinary keys, numeric keys and function keys. When one of the key structures 10 is depressed by the user's finger, the keyboard device 1 generates a corresponding key signal to a computer, and thus the computer executes a corresponding function. For example, when an ordinary key is depressed, a corresponding English letter or symbol is inputted into the computer. When a numeric key is depressed, a corresponding number is inputted into the computer. In addition, the function keys (F1~F12) can be programmed to provide various quick access functions.

The key structure 10 of the keyboard device 1 will be described in more details as follows. Please refer to FIGS. 2, 3, 4 and 5 again. The key structure 10 comprises a plate assembly 11, a keycap 12, a connecting member 13 and a buffering element 14. The plate assembly 11 has a hollow region 110. The keycap 12 is located over the plate assembly 11. Moreover, the keycap 12 comprises at least one hook 120. In this embodiment, the hollow region 110 of the plate assembly 11 and the hook 120 of the keycap 12 are aligned with each other. The number of the at least one hook 120 may be adjusted according to the size of the keycap 12. For example, in case that the key structure is a "Shift" key, a space or any other similar multiple key with the larger area and length, the key structure is equipped with more hooks than the ordinary key structure (e.g., the numeric key). That is, the number of the at least one hook 120 is not restricted. The connecting member 13 is arranged between the keycap 12 and the plate assembly 11. The keycap 12 is connected with the connecting member 13 through the hook 120. Consequently, the keycap 12 is movable upwardly or downwardly relative to the plate assembly 11 through the connecting member 13. Preferably but not exclusively, the connecting member 103 is a scissors-type connecting member. The buffering element 14 is installed on the plate assembly 11. The buffering element 14 is extended in the direction toward the keycap 12 and penetrated through the hollow region 110 of the plate assembly 11. As the keycap 12 is moved downwardly toward the plate assembly 11, the hook 120 is moved downwardly. When the hook 120 is contacted with the buffering element 14, there is a gap G between the keycap 12 and the plate assembly 11.

As mentioned above, in each key structure 10 of the keyboard device 1, the buffering element 14 is installed on the plate assembly 11. While the key structure 10 is depressed, the keycap 12 is moved downwardly toward the plate assembly 11 and the hook 120 is contacted with the buffering element 14. Due to the interference between the hook 120 of the keycap 12 and the buffering element 14, the keycap 12 is stopped at a specified position. Meanwhile, there is the gap G between the keycap 12 and the plate assembly 11. Due to the structural design, the keycap 12 will not directly collide with the plate assembly 11. Since the generated sound is reduced during the process of depressing the key structure 10, the noise reduction efficacy is enhanced.

Please refer to FIGS. 1, 2, 3, 4 and 5 again. In an embodiment, the plate assembly 11 comprises a supporting plate 111 and a membrane circuit board 112. The supporting plate 111 has a first perforation 1110. The membrane circuit board 112 is arranged between the keycap 12 and the supporting plate 111. The membrane circuit board 112 has a second perforation 1120. The supporting plate 111 and the membrane circuit board 112 are stacked on each other. The first perforation 1110 and the second perforation 1120 are in communication with each other. In addition, the first perforation 1110 and the second perforation 1120 are collaboratively formed as the hollow region 110 of the plate assembly 11.

In an embodiment, the key structure 10 further comprises a waterproof plate 15. The waterproof plate 15 is located under the plate assembly 11. Particularly, the waterproof plate 15 is located under the supporting plate 111, and the membrane circuit board 112, the supporting plate 111 and the waterproof plate 15 are stacked on each other sequentially from top to bottom. The waterproof plate 15 attached on the bottom surface of the supporting plate 111 can prevent the ambient moisture from entering the inner portion of the keyboard device 1. Consequently, the electronic components within the keyboard device 1 are not damaged by the moisture.

In an embodiment, the waterproof plate 15 and the buffering element 14 are integrally formed as a one-piece structure. That is, the waterproof plate 15 with the buffering element 14 is produced by using a stamping process or an injection molding process. Preferably but not exclusively, the waterproof plate 15 and the buffering element 14 are made of polycarbonate (PC) or polyethylene terephthalate (PET).

In the above embodiment, the key structure 10 is equipped with the waterproof plate 15. It is noted that numerous modifications and alterations may be made while retaining the teachings of the invention. For example, in another embodiment, the key structure is not equipped with the waterproof plate. Under this circumstance, the buffering element 15 is disposed within the hollow region 110 of the plate assembly 11.

Please refer to FIGS. 3, 4 and 5. The keycap 12 further comprises an upper portion 121 and a skirt portion 122. The skirt portion 122 is extended from the upper portion 121 in the direction toward the plate assembly 11. Due to the interference between the hook 120 of the keycap 12 and the buffering element 14, the skirt portion 122 of the keycap 12 will not directly collided with the membrane circuit board 112 of the plate assembly 11. That is, when the hook 120 of the keycap 12 interferes with the buffering element 14, there is the gap G between the skirt portion 122 of the keycap 12 and the membrane circuit board 112 of the plate assembly 11.

In an embodiment, the key structure 10 further comprises an elastic element (not shown). The elastic element is arranged between the keycap 12 and the membrane circuit board 112. A membrane switch (not shown) is installed on the membrane circuit board 112. As mentioned above, while the keycap 12 of the key structure 10 is depressed and the keycap 12 is moved downwardly toward the plate assembly 11 through the connecting member 13, the hook 120 of the keycap 12 is contacted with the buffering element 14. As the keycap 12 is moved downwardly to compress the elastic element, the membrane switch on the membrane circuit board 112 is pushed and triggered by the elastic element. That is, when the hook 120 of the keycap 12 and the buffering element 14 interfere with each other, the membrane switch on the membrane circuit board 112 is triggered.

Especially, the buffering element 14 is made of the material with elasticity. Consequently, when the hook 120 of the keycap 12 and the buffering element 14 interfere with each other, the buffering element 14 is subjected to elastic deformation. The deformation amount T of the buffering element 14 is in the range between 0.05 mm and 1 mm. It is noted that the deformation amount T is not restricted. As long as there is the gap G between the keycap 12 and the plate assembly 11 and the membrane switch on the membrane circuit board 112 is triggered in response to the interference between the hook 120 of the keycap 12 and the buffering element 14, the above design may be modified. For example, when the hook 120 of the keycap 12 is contacted with the buffering element 14, the buffering element 14 is not subjected to the elastic deformation.

Figure 6:
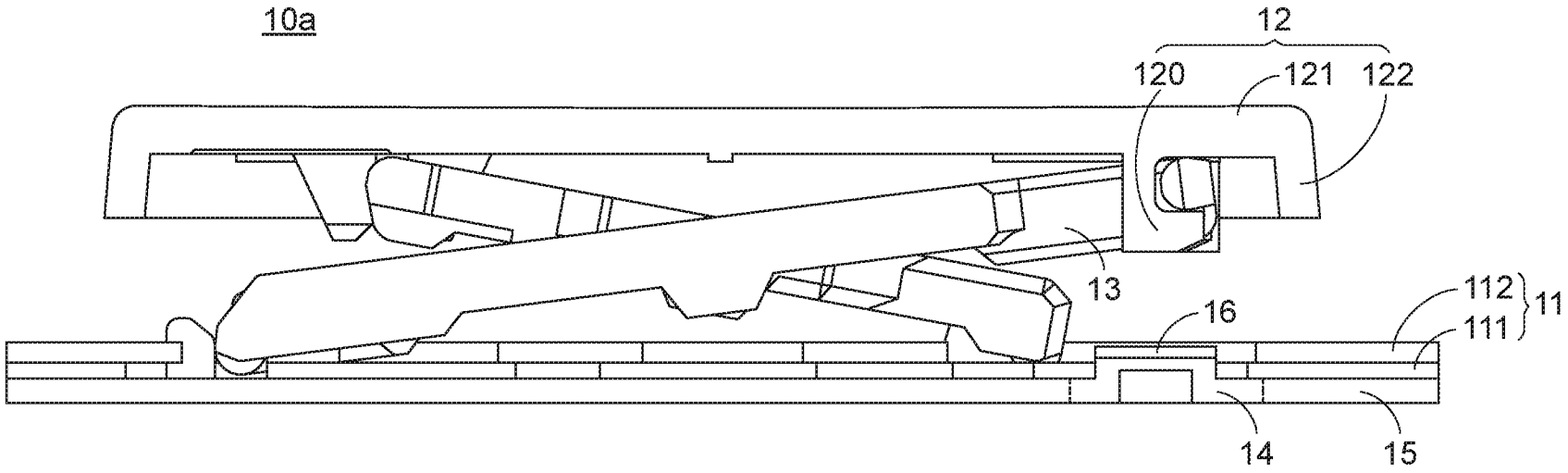
FIG. 6 is a schematic cross-sectional view illustrating a key structure according to another embodiment of the present invention.

FIG. 6 is a schematic cross-sectional view illustrating a key structure according to another embodiment of the present invention. In comparison with the key structure of the above embodiment, the key structure 10*a* further comprises an elastic layer 16. The elastic layer 16 is disposed on a top surface of the buffering element 14. Due to the elastic layer 16, the buffering efficacy is enhanced. While the keycap 12 of the key structure 10 is depressed, the keycap 12 is moved downwardly toward the plate assembly 11 through the connecting member 13. When the hook 120 of the keycap 12 is contacted with the elastic layer 16 of the buffering element 14*a*, there is the gap between the keycap 12 and the plate assembly 11. Preferably but not exclusively, the elastic layer 16 is made of silicone resin or rubber.

From the above descriptions, the present invention provides the keyboard device. The plate assembly of the key structure of the keyboard device is equipped with the buffering element. While the keycap of the key structure is depressed, the keycap is moved downwardly toward the plate assembly through the connecting member. When the at least one hook of the keycap is contacted with the buffering element, there is the gap between the keycap and the plate assembly. Due to the structural design, the keycap will not directly collide with the plate assembly. Since the generated sound is reduced during the process of depressing the key structure, the noise reduction efficacy is enhanced.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A keyboard device comprising plural key structures, wherein each key structure comprises:

a plate assembly having a hollow region;

a keycap located over the plate assembly, and comprising at least one hook;

two connecting members connected between the keycap and the plate assembly, and each of the two connecting members having an upper end connected to the keycap and a lower end connected to the plate assembly, wherein the keycap is connected with the upper end of one of the connecting members through the at least one hook, and the keycap is movable upwardly or downwardly relative to the plate assembly through the two connecting members; and a buffering element installed on the plate assembly, wherein the buffering element is extended in a direction toward the keycap and penetrated through the hollow region of the plate assembly, wherein a top surface of the buffering element is lower than a top surface of the plate assembly, and a vertical projection of the top surface of the buffering element is separated from vertical projections of the lower ends of the two connecting members, wherein while the keycap is moved downwardly toward the plate assembly and the at least one hook of the keycap is contacted with the top surface of the buffering element, there is the gap between the keycap and the plate assembly.

2. The keyboard device according to claim 1, wherein when the at least one hook of the keycap is contacted with the top surface of the buffering element, the buffering element is subjected to an elastic deformation, wherein a deformation amount of the buffering element corresponding to the elastic deformation is in a range between 0.05 mm and 1 mm.

3. The keyboard device according to claim 1, wherein the plate assembly comprises:

a supporting plate having a first perforation; and a membrane circuit board arranged between the keycap and the supporting plate, and comprising a second perforation, wherein the first perforation and the second perforation are in communication with each other, and the first perforation and the second perforation are collaboratively formed as the hollow region.

4. The keyboard device according to claim 3, wherein the keycap further comprises an upper portion and a skirt portion, wherein the skirt portion is extended from the upper portion in a direction toward the plate assembly, wherein when the at least one hook of the keycap is contacted with the top surface of the buffering element, there is the gap between the skirt portion and the membrane circuit board of the plate assembly.

5. The keyboard device according to claim 1, wherein the key structure further comprises a waterproof plate, and the waterproof plate is located under the plate assembly, wherein the waterproof plate and the buffering element are integrally formed as a one-piece structure.

6. The keyboard device according to claim 5, wherein the waterproof plate and the buffering element are made of polycarbonate or polyethylene terephthalate.

7. The keyboard device according to claim 1, wherein the key structure further comprises a waterproof plate, and the waterproof plate is located under the plate assembly, wherein the buffering element is disposed on the waterproof plate.

8. The keyboard device according to claim 7, wherein the waterproof plate is made of polycarbonate or polyethylene terephthalate, and the buffering element is made of silicone resin or rubber.

9. The keyboard device according to claim 1, wherein each key structure further comprises an elastic layer, wherein the elastic layer is disposed on a top surface of the buffering element, wherein while the keycap is moved downwardly toward the plate assembly and the at least one hook of the keycap is contacted with the elastic layer, there is the gap between the keycap and the plate assembly.

10. A key structure, comprising:

a plate assembly having a hollow region;

a keycap located over the plate assembly, and comprising at least one hook;

two connecting members connected between the keycap and the plate assembly, and each of the two connecting members having an upper end connected to the keycap and a lower end connected to the plate assembly, wherein the keycap is connected with the upper end of one of the connecting member through the at least one hook, and the keycap is movable upwardly or downwardly relative to the plate assembly through the two connecting members; and a buffering element installed on the plate assembly, wherein the buffering element is extended in a direction toward the keycap and penetrated through the hollow region of the plate assembly, wherein a top surface of the buffering element is lower than a top surface of the plate assembly, and a vertical projection of the top surface of the buffering element is separated from vertical projections of the lower ends of the two connecting members, wherein while the keycap is moved downwardly toward the plate assembly and the at least one hook of the keycap is contacted with the top surface of the buffering element, there is the gap between the keycap and the plate assembly.

11. The keyboard device according to claim 1, wherein a vertical projection of the at least one hook is separated from the vertical projections of the lower ends of the two connecting members.

12. The key structure according to claim 10, wherein a vertical projection of the at least one hook is separated from the vertical projections of the lower ends of the two connecting members.

* * * * *